US006142606A

United States Patent [19]

Kubota et al.

[11] Patent Number: 6,142,606

[45] Date of Patent: Nov. 7, 2000

[54] INK JET RECORDING HEAD, SUBSTRATE FOR USE OF SUCH HEAD, INK JET CARTRIDGE, AND INK JET RECORDING APPARATUS

[75] Inventors: Masahiko Kubota, Tokyo; Masashi Kitani, Yokohama; Masami Kasamoto, Ayase; Shuji Koyama, Kawasaki, all of Japan

[73] Assignee: Canon Kabushiki Kaisha, Tokyo, Japan

[21] Appl. No.: 09/215,740

[22] Filed: Dec. 17, 1998

[30] Foreign Application Priority Data

Dec. 22, 1997 [JP] Japan ..... 9-353450

[51] Int. Cl.[7] ..... B41J 2/135

[52] U.S. Cl. ..... 347/45; 347/64

[58] Field of Search ..... 347/45, 64, 67

[56] References Cited

U.S. PATENT DOCUMENTS

| | | | |
|---|---|---|---|
| 4,368,476 | 1/1983 | Uehara et al. | 346/140 |
| 4,596,994 | 6/1986 | Matsuda et al. | 347/64 |
| 5,187,499 | 2/1993 | Murakami . | |
| 5,729,261 | 3/1998 | Burke et al. | 347/45 |

FOREIGN PATENT DOCUMENTS

| | | |
|---|---|---|
| 57-72867 | 5/1982 | Japan . |
| 57-72868 | 5/1982 | Japan . |
| 60-159060 | 8/1985 | Japan . |
| 4-12860 | 1/1992 | Japan . |
| 4-12861 | 1/1992 | Japan . |
| 4-12862 | 1/1992 | Japan . |

*Primary Examiner*—John Barlow
*Assistant Examiner*—Helen Mahoney
*Attorney, Agent, or Firm*—Fitzpatrick, Cella, Harper & Scinto

[57] ABSTRACT

An ink jet recording head comprises ink paths communicated with ink discharge ports for discharging ink, and heat generating portions arranged on the inner wall faces of the ink paths for generating thermal energy utilized for discharging ink from the discharge ports. For this ink jet recording head, liquid-repellent treatment is processed only on the regions that correspond to the heat generating portions of the inner wall faces of the ink paths. With the liquid-repellent treatment processed only on the regions corresponding to the heat generating portions on the inner wall faces of the ink paths, it is made difficult for the refractory substances that may be brought about by the decomposition of colorant or the like contained in ink to be fixed on the regions corresponding to the heat generating portions. As a result, the heat of each heat generating device is transferred to ink evenly to make stable ink discharges obtainable for the provision of recorded images in higher quality.

26 Claims, 5 Drawing Sheets

INK JET RECORDING HEAD, SUBSTRATE FOR USE OF SUCH HEAD, INK JET CARTRIDGE, AND INK JET RECORDING APPARATUS

BACKGROUND OF THE INVENTION

1. Field of the Invention

The present invention relates to an ink jet recording head that records by discharging recording liquid (which may be referred to as ink) from the discharge ports by the utilization of thermal energy to cause ink to adhere to a recording medium, and also, relates to a substrate for use of such head. The invention also relates to an ink jet cartridge and an ink jet recording apparatus. More particularly, the invention relates to a substrate of ink jet recording heads used for an ink jet recording head of the kind, which is provided with the heat generating units arranged for it to generate thermal energy, and also, relates to an ink jet recording head formed by use of such substrate, an ink jet cartridge, and an ink jet recording apparatus as well.

2. Related Background Art

There has been known conventionally the so-called bubble jet recording method, that is, an ink jet recording method whereby to discharge ink from the discharge ports by the utilization of acting force exerted by the abrupt change of states following the creation of bubbles in ink by the application of thermal energy given to ink. In general, the ink jet recording apparatus that adopts this bubble jet recording method uses an ink jet recording head provided with the discharge ports from which ink is discharged; ink paths communicated with the discharge ports; heat generating devices that apply thermal energy to the ink which is distributed in each of ink paths. Each of the heat generating devices is arranged on a silicon substrate formed by means of semiconductor wafer process technologies and techniques. Each of the ink paths is structured by bonding a ceiling plate member having the discharge ports and the grooves which are communicated with the discharge ports formed on this plate with the substrate having the heat generating devices arranged on it after having positioned the heat generating devices and the grooves so as to enable them to face each other.

In accordance with a recording method of the kind, it is possible to record images in higher quality at higher speeds with a lesser amount of noises. At the same time, it becomes possible to arrange the discharge ports of the recording head in higher density. Among many advantages, therefore, this method has a remarkable advantage that with a smaller apparatus, it is easier to obtain recorded images in higher resolution, and in colors as well. As a result, this recording method has been utilized widely in recent years for a printer, a copying machine, a facsimile equipment, and many other office equipments.

Nevertheless, for example, if it is attempted to implement a full-line arrangement in a density higher still, there is a need even for such an ink jet recording apparatus as described above a higher level of technological standard from the viewpoint of the manufacture of recording heads that directly affect the design considerations of its structure, the recording accuracy, and the reliability and durability of the recording head, as well as its productivity and adoptability for the large-scale production. In the specifications of Japanese Patent Laid-Open Application Nos. 57-72867 and 57-72868, there are disclosed ink jet recording heads, each provided with a substrate having on one and the same substrate the heat generating devices, and the functional devices that form various circuits to control the drivers that drive the heat generating devices, and also, control each driving of the heat generating devices.

In this respect, however, since the ink jet recording heads disclosed in the specifications of these Japanese Patent Laid-Open Application Nos. 57-72867 and 57-72868 are structured each by the provision of the heat generating devices and the functional devices used for them on one and the same substrate in order to enhance its integrational structure, respectively. Therefore, the size of each device, the width of each electric wire, and each gap between electric wires should be made comparatively small eventually. Here, if the structure should be arranged as disclosed in the specifications of Japanese Patnet Laid-Open Application No. 60-159060 so that an inorganic insulator is formed as a first protection film on the heat generating devices, and an inorganic material is provided as a second protection film, there tends to occur failure due to the short circuit between the electric wiring members and the second protection film, which may be caused by the defective formation of the first protection film in its film formation process or by the defects or the like that may take place due to membrane stress occurring in the film formation of the second protection film.

Also, for each of the ink jet recording heads disclosed in the specifications of Japanese Patent Laid-Open Application Nos. 57-72867 and 57-72868, a number of heat generating devices and functional devices are formed on a substrate at the same time. As a result, each layer is formed on the substrate repeatedly one after another on this substrate and a part of the layer is removed likewise in the head manufacture processes. Therefore, when the uppermost layer is formed, the surface thereof shows fine irregularities having step wedge portions (stepped portions) thereon. For that matter, the step coverage capability on the uppermost layer becomes very important in consideration of the stepped portions thus existing. In other words, if the step coverage at the stepped portions is unfavorable, ink or other recording liquid tends to be permeated through such portions when the substrate is used as a recording head, and electrolytic corrosion or electric insulation breakage may take place as the case may be. Also, if the probability of the occurrence of such defective portions is not small on the uppermost layer formed due to the way of manufacture of the substrate, recording liquid may be allowed to permeate through them to make the life of heat generating devices and the electric wiring shorter considerably.

In this respect, therefore, it is attempted to provide the first protection film in order to improve the step coverage as to the stepped portions of the second protection film even in a case where each width of wires and the gap between each of them are small. With this arrangement, however, the efficiency of heat transfer is lowered between each of the heat generating devices and the surface of the second protection film. The efficiency of the electrothermal conversion is also lowered. Therefore, to maintain the thermal energy on the surface of the second protection film, it is necessary to increase the voltage applied to each of the heat generating devices to the extent that the thermal energy may be lost by the presence of the first protection film, and compensate such efficiency of heat transfer thus lowered. Here, for the improvement of such efficiencies, the thickness of the protection film formed on each heat generating device may be made as small as possible. With the thinner protection film, however, it becomes difficult not only to maintain the step coverage on the stepped portions, but also, lower the probability of the occurrence of defects at least to the extent that such occurrence may be negligible in practice. Further, from the structural viewpoint of the substrate, at least one layer of insulation film is needed. Also, ink of pH 3 to pH 10 is used depending on its usage. Therefore, the protection film which should be in contact with ink is not allowed to be dissolved with the pH of 3 to 10.

Here, $SiO_2$ film is often used as the first protection film, because it has a comparatively good mechanical strength, and contactness with the cavitation proof film formed by metallic material such as Ta. However, since the $SiO_2$ film is dissolved by the strong base alkaline solution, there is a possibility that if the cavitation proof film of Ta or the like should carry some defects, the $SiO_2$ film may be in contact with ink and dissolved eventually. Then, the Al that forms electrodes is also dissolved. Lastly, the electric breakage may be caused in some cases.

Also, for the same reasons for the adoption of the $SiO_2$ film as described above, $Si_3N_4$ film may also be used as the first protection film. However, since the $Si_3N_4$ film is formed by the application of CVD method, the film formation temperature is 300° C. to 400° C., which is comparatively high as compared with the sputtering method. Here, although the $Si_3N_4$ film may be formed at a lower temperature of 200° C. to 300° C., its contactness is lowered with the metallic nitride, such as TaN, which is the formation material of the heat generating devices. Now, therefore, if the $Si_3N_4$ film should be formed at a temperature of as high as 300° C. to 400° C., the hillocks (extrusions) are developed in the $Si_3N_4$ film on the Al layer which is the material of the electrodes. Then, there is a possibility that short circuit is caused to occur with the second protection film which is formed later by metallic material such as Ta.

Further, in other words, when the heat generating devices are driven, liquid on each of them is heated and vaporized by the film boiling thus generated, and then, coagulated instantaneously. As a result, in the vicinity of each of the heat generating devices, foaming and coagulations are repeated at a high frequency of several thousands times per second. Conceivably, therefore, the pressure changes (cavitation and corrosion) cause the substrate to be damaged as the case may be.

Now, meanwhile, the ink jet recording heads of cartridge type having ink tank and head integrally formed for use are sold on the market in a considerable amount recently. For an ink jet recording head of the kind, it should be good enough if only its durability is maintained at least until ink in the ink tank is completely used in this particular case. On the other hand, along with the increasing demands on the ink jet recording heads, it is attempted to develop them so as to be suitably usable in more varied fields. As a result, it becomes necessary for them to use different recording liquids in order to meet the requirement of different uses. As described above, however, the recording liquid should be vaporized, and the heat generating devices should be heated to a high temperature in an extremely short period of time. As a result, the colorant and other components contained in ink are decomposed at its molecular level to become the refractory substances. Then, there is a tendency that such substances adhere to the heat generating devices firmly. If the organic or inorganic refractory substrates are fixed on the heat generating devices firmly, the heat transfer from each of them to recording liquid becomes uneven to make the foaming of recording liquid instable.

SUMMARY OF THE INVENTION

It is an object of the present invention to provide an ink jet recording head capable of suppressing the reduction of heat conversion efficiency, and performing stable foaming of recording liquid by making it difficult to allow refractory substances to be fixed to the heat generating devices thereof, a substrate for use of such head, an ink jet cartridge, and ink jet recording apparatus.

It is another object of the invention to provide an ink jet recording head capable of attaining the provision of recorded images in higher quality by making the stable foaming of recording liquid possible, a substrate for use of such head, an ink jet cartridge, and an ink jet recording apparatus.

It is still another object of the invention to provide an ink jet recording head which comprises ink paths communicated with ink discharge ports for discharging ink; and heat generating portions arranged on the inner wall faces of the ink paths for generating thermal energy utilized for discharging ink from the discharge ports, and for which liquid-repellent treatment is processed only on the regions that correspond to the heat generating portions of the inner wall faces of the ink paths.

It is a further object of the invention to provide a substrate for use of an ink jet recording head, which comprises ink paths communicated with ink discharge ports for discharging ink; and heat generating portions arranged on the inner wall faces of the ink paths for generating thermal energy utilized for discharging ink from the discharge ports, and for which liquid-repellent treatment is processed only on the regions corresponding to the heat generating portions of the inner wall faces of the ink paths.

It is still a further object of the invention to provide an ink jet cartridge which comprises an ink jet recording head described above, and an ink tank for retaining ink to be supplied to such ink jet recording head.

It is another object of the invention to provide an ink jet recording apparatus which comprises an ink jet recording head described above, and means for supplying recording signals for supplying recording signals to drive the ink jet recording head, and the recording thereof is performed by discharging ink from the ink jet recording head in accordance with recording signals.

It is another object of the invention to provide an ink jet recording apparatus which comprises holding means for detachably holding the ink jet cartridge described above, and means for supplying recording signals for supplying recording signals to drive the ink jet recording head, and the recording thereof is performed by discharging ink from the ink jet recording head in accordance with recording signals.

As has been described above, with the liquid-repellent treatment processed only on the regions corresponding to the heat generating portions on the inner wall faces of the ink paths, it is made difficult for the refractory substances that may be brought about by the decomposition of colorant or the like contained in ink to be fixed on the regions corresponding to the heat generating portions. As a result, the heat of each heat generating device is transferred to ink evenly to make stable ink discharges obtainable.

It is preferable to make the inner wall faces lyophilic with the exception of the regions that correspond to the heat generating portions. In this manner, it becomes possible to maintain the ink supply characteristics in good condition.

The regions corresponding to the heat generating portions are typically the inner wall faces of the ink paths corresponding to the heat generating resistive layer between pairs of electrodes and portions nearby. Also, the regions corresponding to the heat generating portions are typically formed on the uppermost layer of plural protection layers provided for the heat generating portions. It is preferable to form this uppermost layer with a film containing tantalum. Also, it is a preferable mode if an organic film is formed by means of the liquid-repellent treatment.

As the liquid-repellent treatment, it is preferable to adopt a process using fluorine. Also, in order to suppress the fixation of the refractory substances on each of the heat generating devices effectively, it is preferable to perform a process so as to make the contact angle with ink 80° or more or particularly, 100° or more as the liquid-repellent treatment. It is also preferable to make the thickness of the film of the liquid-repellent treatment 5,000 Å or less in order to transfer the heat generated by each of the heat generating devices to ink efficiently.

DETAILED DESCRIPTION OF THE PREFERRED EMBODIMENTS

Hereinafter, with reference to the accompanying drawings, the description will be made of the embodiments in accordance with the present invention.

First Embodiment

Figure 1:
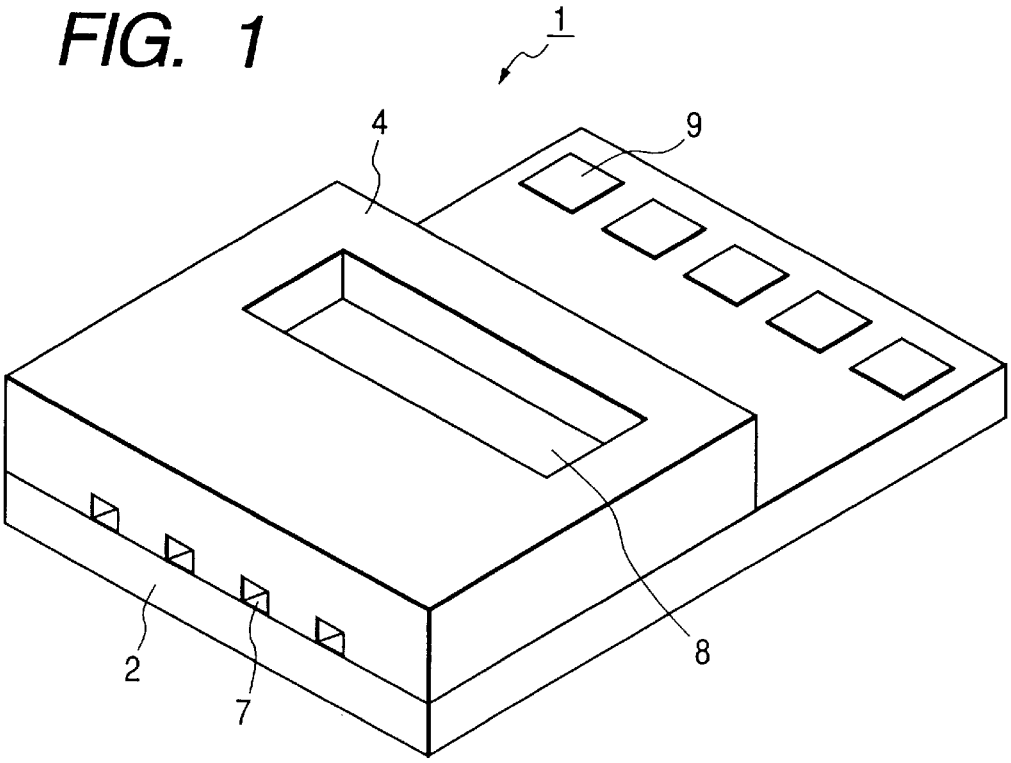
FIG. 1 is a perspective view which schematically shows an ink jet recording head in accordance with one embodiment of the present invention.
Figure 2:
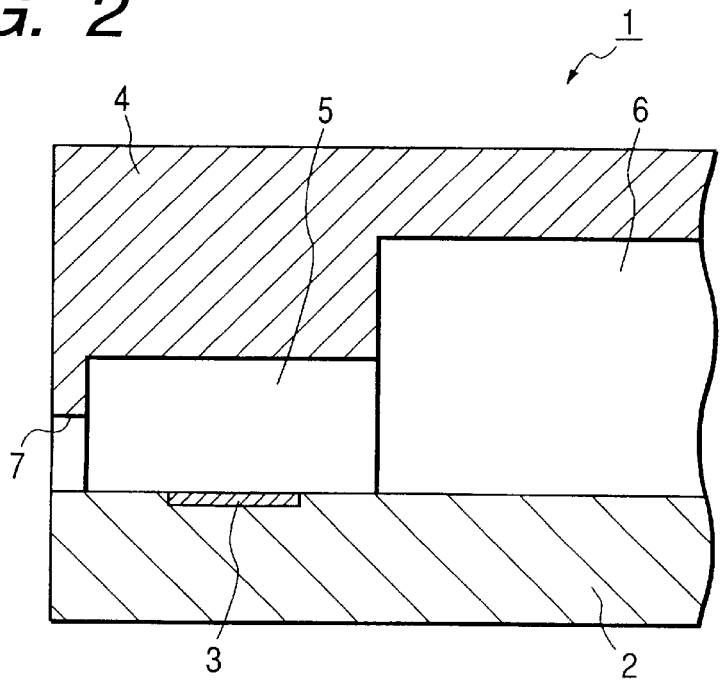
FIG. 2 is a cross-sectional view which shows the ink jet recording head represented in FIG. 1, taken in the direction of liquid flow paths of the head schematically.

FIG. 1 is a perspective view which schematically shows an ink jet recording head in accordance with one embodiment of the present invention. Also, FIG. 2 is a cross-sectional view which shows the ink jet recording head represented in FIG. 1, taken in the direction of liquid flow paths of the head schematically.

In accordance with the present embodiment, the ink jet recording head 1 comprises an element substrate 2 provided with a plurality of heat generating devices 3 arranged in parallel (in FIG. 2, only one of them is shown) which generate thermal energy to be utilized for creating bubbles in ink, and a ceiling plate 4 which is bonded to the element substrate 2. On the element substrate 2, a plurality of electrode pads 9 are arranged to receive electric signals from the outside in order to drive each of the heat generating devices 3. The element substrate 2 is a substrate having silicon material as its base. There are formed on the element substrate 2, each of the heat generating devices 3, the electric wiring that connects the electrode pads 9 and heat generating devices 3, and the functional devices that form the driver circuit and the like to drive heat generating device 3 by use of the semiconductor wafer process technologies and techniques.

On the ceiling plate 4, there are formed the grooves that form a plurality of liquid flow paths 5 and the common liquid chamber 6 from which ink is supplied to each of the liquid flow paths 5. When the ceiling plate 4 is bonded to the element substrate 2, the liquid flow paths 5 and the common liquid chamber 6 are structured. When bonding, the element substrate 2 and the ceiling plate 4 are positioned so as to enable the grooves that constitute the liquid flow paths 5 to be in agreement with the heat generating devices 3, respectively. In this manner, each of the liquid flow paths 5 is formed with each of the heat generating devices 3 correspondingly. Also, on the ceiling plate 4, there are provided a plurality of discharge ports 7 each communicated with each of the liquid flow paths 5, and an ink supply opening 8 through which ink is supplied from the outside to the common liquid chamber 6.

Figure 3:
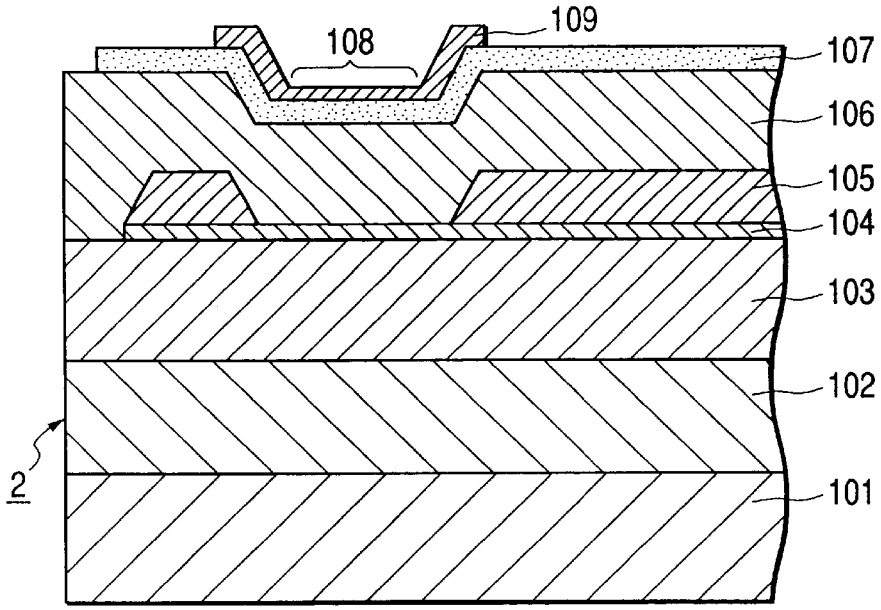
FIG. 3 is a side sectional view which shows schematically the circumference of the heat generating portion of the element substrate of the ink jet recording head represented in FIG. 1.
Figure 4:
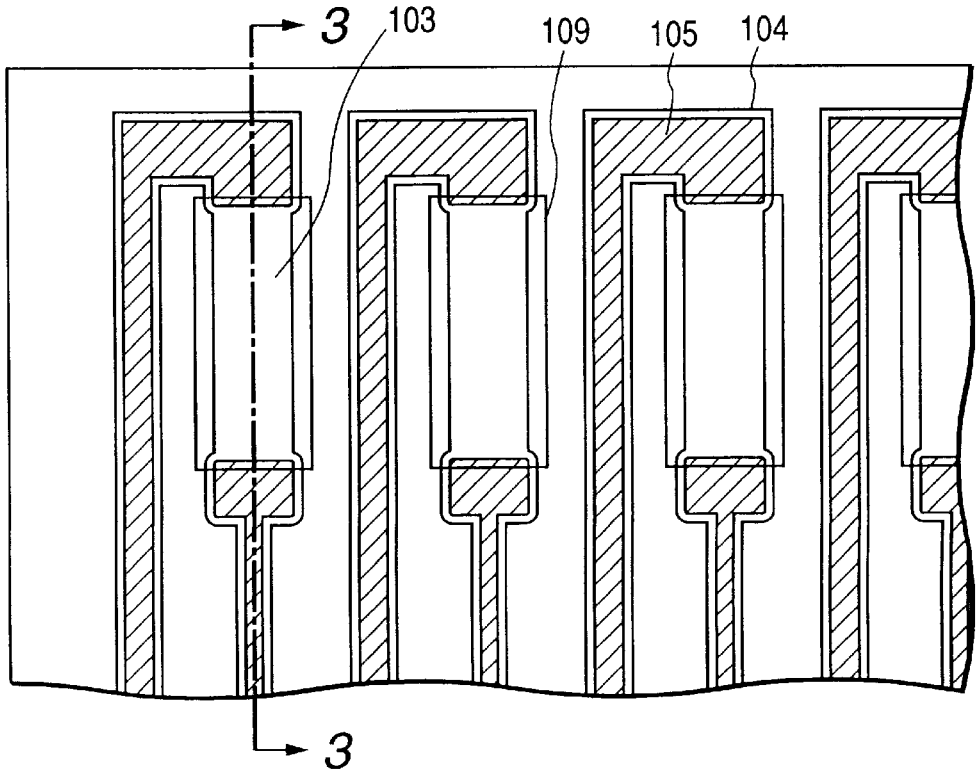
FIG. 4 is an upper end view which schematically shows the circumference of the heat generating portion of the element substrate of the ink jet recording head represented in FIG. 3.

Now, with reference to FIG. 3 and FIG. 4, the detailed description will be made of the element substrate 2 of the ink jet recording head 1. FIG. 3 is a side sectional view which schematically shows the circumference of the heat generating portion of the element substrate of the ink jet recording head represented in FIG. 1. FIG. 4 is an upper end view which schematically shows the circumference of the heat generating portion of the element substrate of the ink jet recording head represented in FIG. 3. FIG. 3 is side sectional view which schematically shows the corresponding portion, taken along one dot line 3—3 in FIG. 4.

On the silicon substrate 101 serving as the base of the element substrate 2, there are laminated the thermally oxidized film 102 which serves as the heat accumulation layer, and the interlayer film 103 which is formed by silicon oxide ($SiO_2$) or silicon nitride ($Si_3N_4$) and which dually serves as the heat accumulation layer. On the interlayer film 103, the heat generating resistive layer 104, and the wiring 105 formed by Al or Al alloy such as Al—Si or Al—Cu are patterned respectively. Then, there are laminated on them, the protection layer 106 formed by silicon oxide ($SiO_2$) or silicon nitride ($Si_3N_4$), and also, the cavitation proof film 107 formed by Ta to protect the protection film 106 from the chemical and physical shocks following the heat generation of the resistive layer 104. In this respect, the region on the heat generating resistive layer 104 where the wiring 105 is not formed, that is, the heat generating resistive layer 104 between the wirings 105 which serve as a pair of electrodes, is arranged to function as each of the heat generating devices. Here, a reference numeral 108 designates the thermal activating portion where heat acts upon ink. In this manner, each of the layers is formed on the silicon substrate by means of the semiconductor manufacture technologies and techniques to constitute the substrate for use of an ink jet recording head.

The heat generating resistive layer 104 is structured to contain $TaN_{0.8,hex}$. The manufactured heat generating resistive layers, each containing $TaN_{0.8,hex}$, presents smaller variations in its property, and even if a number of heat generating devices 3 are formed on one and the same substrate, its function is stabilized, and, further, the resistance changes are smaller even when its operational condition may change. Therefore, with such functional stability of a number of heat generating devices 3, it is possible to enable each of them to demonstrate the same effect in operation.

Figure 5:
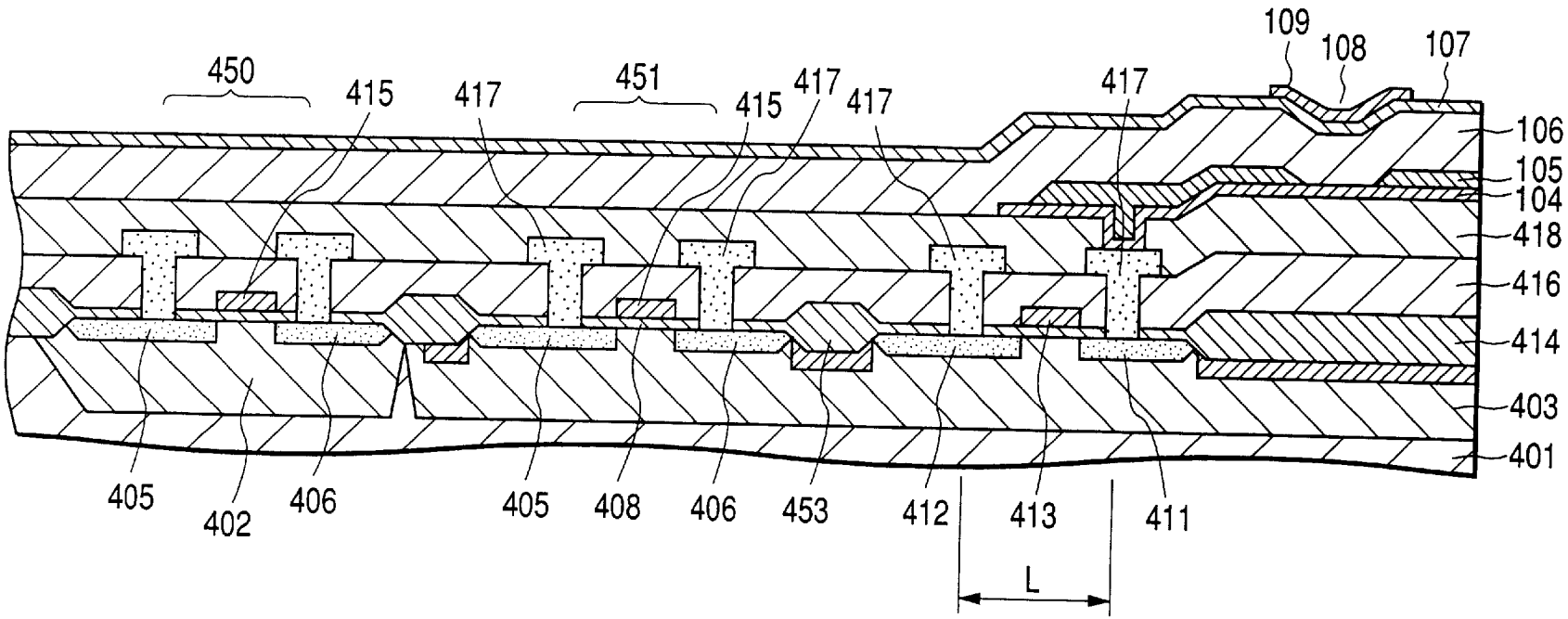
FIG. 5 is a side sectional view which shows schematically the element substrate of the ink jet recording head represented in FIG. 3, which is cut vertically.

FIG. 5 is a side sectional view schematically showing the element substrate of the ink jet recording head represented in FIG. 3, which is cut vertically.

Using the general MOS (metal oxide silicon) formation process the impurity installation such as ion plantation and its diffusion are conducted to form the p-MOS on the n-type well region 402 of the silicon substrate 401, which is p conductor, and the n-MOS 451 on the p-type well region 403, respectively. The p-MOS 450 and the n-MOS 451 comprise the gate wiring 415, the source region 405 where the n-type or p-type impurity is implanted, the drain region 406, and some others, which are formed by polysilicon deposited by means of the CVD method in a thickness of 4,000 Å or more and 5,000 Å or less through the gate insulation film 408 of several hundreds Å, respectively. Then, the C-MOS logic is constructed by these p-MOS and n-MOS.

Also, on the p-type well region 403, the n-MOS transistor is arranged for use of element driving, which comprises the drain region 411, the source region 412, the gate wiring 413, and others formed also by the process of impurity installation and diffusion or the like.

Here, if the n-MOS transistor is used for the driver that drives the devices, the distance L between drain and gate that form one transistor is 10 $\mu$m minimum approximately. This 10 $\mu$m breaks down as follows.

The Al electrode 417, which is the contact of the source and drain, is 2×2 $\mu$m. In practice, however, a half of this contact is shared by the adjacent transistor. Therefore, it is a half of 2×2 $\mu$m. The gap between the Al electrode 417 and the gate wiring 413 is 2×2 $\mu$m=4 $\mu$m. The gate wiring 413 is also 4 $\mu$m. The total thus makes 10 $\mu$m.

Between the respective elements, the oxidized film separation region 453 is formed by means of the field oxidation in a thickness of 5,000 Å to 10,000 Å to separate each of the elements, respectively. The field oxidation film functions as the first heat accumulation layer 414 for the thermal activating portion 108.

After each of the elements is formed, there is installed the interlayer insulation film 416 formed by PSG (Phospho-Silicate Glass) film, BPSG (Boron-Doped Phospho-Silicate Glass) film, or the like, prepared by the CVD method in a thickness of approximately 7,000 Å. Further, subsequent to the smoothing process or the like that has been executed by heat treatment on the interlayer insulation film 416, wiring is made through the contact hole on the first wiring layer 417 formed by the Al electrodes. Then, the interlayer insulation film 418, which is formed by $SiO_2$ film or the like prepared in a thickness of 10,000 Å to 15,000 Å, is installed by plasma CVD. Then, furthermore, the resistive layer 104, which is formed by $TaN_{0.8,hex}$ film prepared in a thickness of approximately 1,000 Å, is installed by DC sputtering method. This resistive layer 104 is partly in contact with the first wiring layer 417 by way of the through hole. After that, although not shown, the second wiring layer is formed with Al electrodes to serve as wiring to each of the heat generating devices.

Subsequently, the protection film 106, which is formed by $Si_3N_4$ film prepared in a thickness of approximately 10,000 Å, is installed by the application of plasma CVD method. On the protection film 106, the cavitation proof film 107 is deposited with Ta or the like in a thickness of approximately 2,500 Å.

Then, on the thermal activating portion of the protection film 106, fluororesin film is formed as the water-repellent film 109. In accordance with the present embodiment, fluoroalkyl silane ($CF_3(CF_2)_5(CH_2)_2Si(OMe)_3$) is used as the fluorine compound, which is diluted with this compound being given as 1, isopropyl alcohol as 50, and nitric acid as 1, and dropped onto a glass Petri dish. Subsequent to having thermally decomposed it in an electric furnace at 300° C., the film is formed in a thickness of approximately 500 Å by the application of CVD method at the room temperature. The contact angle of this water-repellent film with ink is 110°.

In accordance with the present embodiment, resist is patterned by means of photolithography or the like on the portions other than the heat activating portion and the circumference thereof before the water-repellent film is formed. Then, the water-repellent material is applied to the entire surface. After that, the patterned water-repellent film is formed by the application of lift-off method for peeling off the resist. Here, it may be possible to form the patterned water-repellent film with patterning after the water-repellent material is applied to the entire surface of the protection film 106.

In this respect, the solvent dilution is conducted for the present embodiment. However, it may be possible to use the dry type CVD method without conducting this dilution. For such formation method of water-repellent film, it may be possible to form the film in the plasmic atmosphere after having vaporized fluroroalkyl trimethoxylane (Rf—Si $(OCH_3)_3$,RF=$CF_3(CF_2)_7CH_2CH_2$) in vacuum, for example. In this manner, a water-repellent film is formed with the Rf—Si group being bound in network.

Also, the description has been made of the structure that uses the n-MOS transistor, but it may be possible to use any transistor or the like if only it is capable enough to drive a plurality of heat generating devices individually, and function to attain such fine structure as described above efficiently. In this respect, however, the provision of such driving circuit on the substrate is not necessarily prerequisite for the present invention.

On the element substrate 2 structured as has been described above, the ceiling plate 4 shown in FIG. 1 and FIG. 2 is positioned to face the element substrate 2 so that the grooves which form the liquid flow paths 5 are allowed to be in agreement with the heat generating devices 3, respectively, and then, bonded to complete the ink jet recording head 1.

Second Embodiment

In accordance with the example described above, the water-repellent film is formed by the application of CVD method. However, the water-repellent film 109 may be formed by means of resin coating.

As the formation method of the water-repellent film 109 using resin coating, there is a method whereby to coat the fluoropolymer film, which has the structure of fluorohetero ring in it, only the thermal activating portion in a thickness of 2,000 Å by the application of spin coating method. As the fluororesin, "Cytop CTX-105" (product name: manufactured by Asahi Glass K.K.), "AF 1600" (product name: manufactured by Du Pont Inc.), or "Teflon AF" (product name: Du Pont Inc.) may be cited. The contact angle of this water-repellent film with ink is 100°.

In accordance with the present embodiment, resist is patterned by means of photolithography or the like on the portions other than the thermal activating portion and the circumference thereof before the formation of the water-repellent film, and then, the water-repellent material is provided for the entire surface. After that, by means of the lift-off method for peeling off the resist, the patterned water-repellent film is formed. In this respect, it may be possible to form the patterned water-repellent film with patterning subsequent to having formed the water-repellent material on the entire surface of the protection film 106.

Third Embodiment

Figure 6:
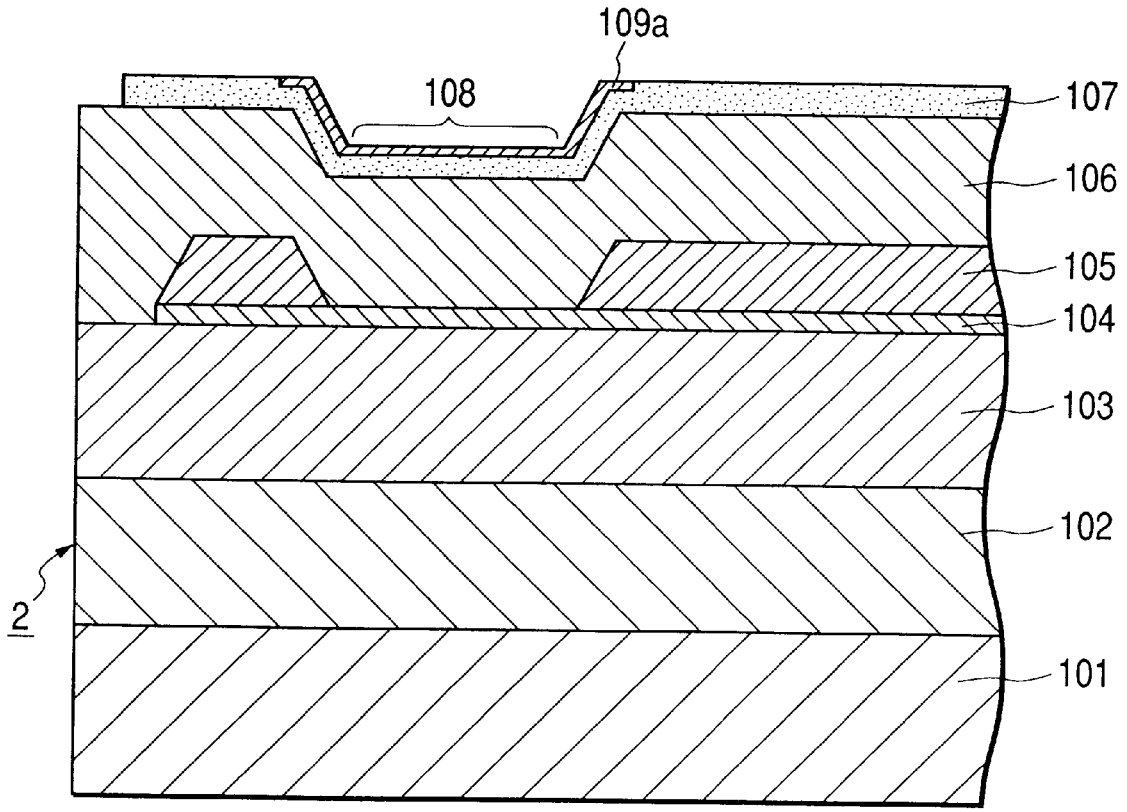
FIG. 6 is a side sectional view which shows schematically the circumference of the heat generating portion of the element substrate of an ink jet recording head in accordance with the other embodiment of the present invention.

In accordance with the present embodiment, the ion injection method is used for the formation of water-repellent film. It becomes possible then to change the properties of only 500 Å on the surface of the water-repellent layer of the cavitation proof film 107 formed in the thickness of 2,500 Å. FIG. 6 is a side sectional view which schematically shows the circumference of the heat activating portion of the element substrate of an ink jet recording head in accordance with the present embodiment.

On the resist applied to the entire surface, the portion corresponding to the plural heat generating portions and circumference thereof is removed like a window by means of photolithographical process. Then, with the ion injection method (ion implantation), fluorine atom is implanted in the cavitation proof film 107 formed by Ta. The fluorine atom is induced into the ion source as gaseous compound and ionized by the application of electronic beam. The ion, which is accelerated by use of the high voltage supply-source of approximately 100 kV, is selected by the mass spectrograph. Thus, only the fluorine atom is implanted in the cavitation proof film 107. In accordance with the present embodiment, fluorine atom is implanted in a unit of $1.0\times10^{14}$ to $1.0\times10^{16}$ atoms/cm$^2$. After that, resist is removed.

The fluorine atom thus implanted at high velocity is caused to elastically collide with Ta atom in the cavitation proof film 107 or it is decelerated by Coulomb's mutual action with electron. Since fluorine atom is comparatively light, this atom penetrates into the crystalline surface of Ta lightly. In order to allow fluorine atom to be stably at rest on the Ta surface by the application of thermal diffusion, the annealing process is executed for 10 to 100 minutes at 300° C. to 500° C.

With the process thus executed, the water-repellent surface, which is formed with the crystal structure having fluorine atom, is arranged only on the heat generating portion. The contact angle of this water-repellent surface with ink is 90°.

On the element substrate 2 structured as has been described above, the ceiling plate 4 shown in FIG. 1 and FIG. 2 is positioned to face the element substrate 2 so that the grooves which form the liquid flow paths 5 are allowed to be in agreement with the heat generating devices 3, respectively, and then, bonded to complete the ink jet recording head 1.

In this respect, as the material for the ceiling plate described in each of the above embodiments, it is preferable to use polysulfone (contact angle with ink: 60°), silicon (contact angle with ink: 70°), glass (contact angle with ink: 70°), or the like. Also, the contact angle with ink of the cavitation proof film 107 formed by Ta is approximately 60°, for example. In this manner, it is preferable to provide lyophilic for the inner wall surface of each of the ink paths with the exception of the region that faces each of the heat generating portions. Thus, it becomes possible to maintain the ink supply characteristics in good condition in each of the ink paths. Here, although the contact angle with ink slightly changes depending on the kinds of ink or the like, each value mentioned in each of the above embodiments is such as measured by use of ink whose surface tension is 30 dyn/cm.

For the ink jet recording head structured as described above, the ink, which is retained temporarily in the common liquid chamber 6 after being supplied from the ink supply opening 8 to it, is caused to enter each of the liquid flow paths 5 by means of the capillary phenomenon, and from meniscus at each of the discharge ports 7, thus keeping each of the liquid flow paths 5 filled with ink. At this juncture, if each of the heat generating devices 3 is energized through the corresponding electrodes to generate heat, ink on each heat generating devices 3 is abruptly heated to create bubble in the corresponding liquid flow paths 5 by means of film boiling thus exerted. With the development of this bubble, ink is discharged from each of the discharge ports 7, respectively.

Here, colorant or compound contained in ink is decomposed at the molecular level when heated by each of the heat generating devices 3 to produce refractory substances in some cases. Since the water-repellent film 109 is formed on the uppermost layer of the thermal activating portion 108 that constitutes each of the heat generating devices 3, such refractory substances can hardly be fixed firmly on each of them irrespective of the kinds of ink to be used. Therefore, even when the heat is used for a long time, the heat conversion efficiency is not easily lowered, and the heat thus generated by each of the heat generating devices 3 is transferred to ink evenly to make it possible to stabilize the creation of bubbles and the development thereof as well. As a result, it becomes possible to attain the stable ink discharges.

Another Embodiment

Now, with reference to FIG. 7, the description will be made of the ink jet recording apparatus on which the above-described ink jet recording head 1 is mounted.

Figure 7:
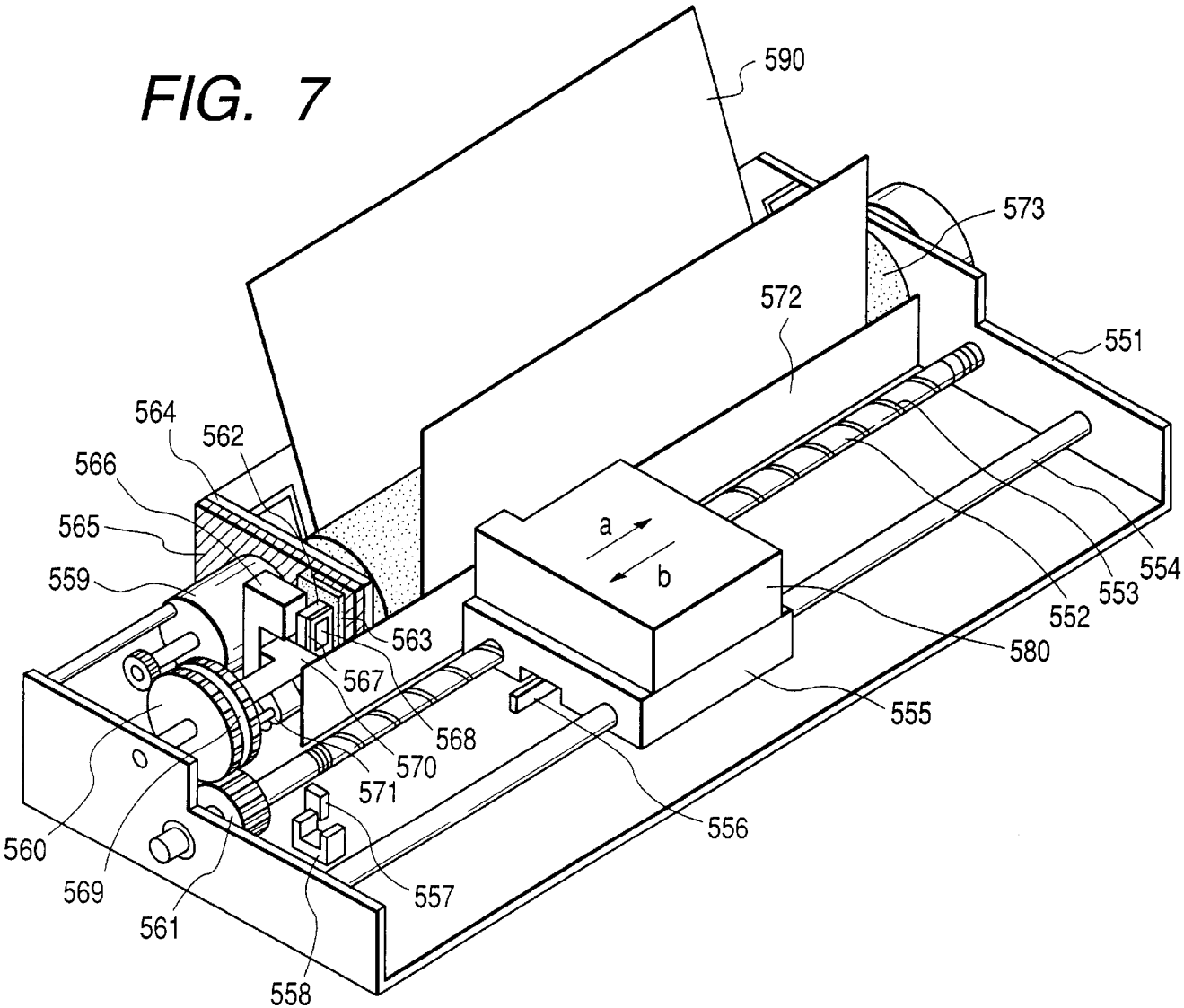
FIG. 7 is a perspective view which schematically shows one example of the principal part of an ink jet recording apparatus in accordance with the present invention.

FIG. 7 is a perspective view which schematically shows one example of the principal part of the ink jet recording apparatus in accordance with the present invention. In FIG. 7, the lead screw 552 provided with a spiral groove 553 cut around it is axially supported on the main body frame 551 rotatively. Interlocked with the regular and reverse rotations of a driving motor 559, the lead screw 552 is driven to rotate through the driving power transmission gears 560 and 561. Further, the guide rail 554, which guides the carriage 555 slidably, is fixed to the main body frame 551. For the carriage 555, a pin (not shown) that engages with the spiral groove 553 is provided, and the carriage 555 reciprocates in the directions indicated by arrows a and b when the lead screw 552 rotates following the rotation of the driving motor 559. The sheet pressure plate 572 is arranged to press a recording medium 590 on the platen roller 573 over the direction in which the carriage 555 travels.

On the carriage 555, an ink jet recording head cartridge 580 is mounted. The ink jet recording head cartridge 580 is formed with the ink jet recording head described above which is formed integrally with an ink tank. Also, the ink jet recording head cartridge 580 is supported on the carriage 555 fixedly by use of positioning means and electric contacts provided for the carriage 555. At the same time, this cartridge is arranged to be detachably mountable on the carriage 555.

Photocoupler 557 and 558 constitute home position detecting means to confirm the presence of the lever 556 of the carriage 555 in this region and cause the driving motor 559 to rotate regularly or reversely, among some other operations. The cap member 567 that caps the front end (the surface where discharge ports are open) of the ink jet recording head is supported by the supporting member 562, and provided with suction means 566. The cap member executes the suction recovery of the ink jet recording head through the aperture 564 in the cap 568. On the supporting plate 564 of the main body, a supporting plate 565 is fixed, and the cleaning blade 563, which is slidably supported by this supporting plate 565, is made movable in the forward and backward directions by driving means (not shown). The configuration of the cleaning blade 563 is not necessarily limited to the one shown in FIG. 7. It is of course possible to adopt any one of know cleaning blades. The lever 570 is arranged to initiate the suction recovery operation of the ink jet recording head. The lever moves along with the movement of the cam 571 which abuts upon the carriage 555, and its movement is controlled by use of the known transmission means such as a clutch or gears, which switches over the driving power from the driving motor 559 as required. Each process of these capping, cleaning, and suction recovery operations is executed in the respective positions correspondingly by the function of the lead screw 552 when the carriage 555 arrives in the region on the home position side. If only these operations are made executable as desired at the known timing, any types of arrangement may be adoptable for the present embodiment.

The ink jet recording apparatus described above is provided with recording signal supply means for supplying recording signals to the ink jet recording head in order to drive the electrothermal converting members of the ink jet recording head mounted on the apparatus. The ink jet recording apparatus is also provided with a controller that controls the operations thereof.

Since the ink jet recording apparatus of the present embodiment mounts on it the ink jet recording head described above, it is possible to implement the operation thereof with the stabilized ink discharges to attain the provision of images whose quality is rarely degraded. Here, in accordance with the present embodiment, the example is shown, in which the ink jet recording head cartridge 580 is detachably mounted on the carriage 555. However, the present invention is not necessarily limited thereto. The structure may be such that the ink jet recording head is installed on the carriage 555, while only the ink tank is made detachably mountable on it.

What is claimed is:

1. An ink jet recording head comprising:

ink paths communicated with ink discharge ports for discharging ink; and heat generating portions arranged on the inner wall faces of said ink paths for generating thermal energy utilized for discharging ink from said discharge ports, liquid-repellent treatment being processed only on the regions corresponding to said heat generating portions of the inner wall faces of said ink paths.

2. An ink jet recording head according to claim 1, wherein the inner wall faces of said ink paths are lyophilic with the exception of the regions corresponding to said heat generating portions.

3. An ink jet recording head according to claim 1, wherein the regions corresponding to said heat generating portions are the inner wall faces of said ink paths corresponding to the heat generating resistive layer positioned between pairs of electrodes and portions nearby.

4. An ink jet recording head according to claim 1, wherein the regions corresponding to said heat generating portions are formed on the uppermost layer of plural protection layers provided for said heat generating portions.

5. An ink jet recording head according to claim 4, wherein said uppermost layer is a film containing tantalum.

6. An ink jet recording head according to claim 1, wherein an organic film is formed by means of said liquid-repellent treatment.

7. An ink jet recording head according to claim 1, wherein said liquid-repellent treatment is a process using fluorine.

8. An ink jet recording head according to claim 1, wherein said liquid-repellent treatment is a process to make the contact angle with ink 80° or more.

9. An ink jet recording head according to claim 1, wherein said liquid-repellent treatment is a process to make the contact angle with ink 100° or more.

10. An ink jet recording head according to claim 1, wherein the thickness of the film provided with said liquid-repellent treatment is 5,000 Å or less.

11. An ink jet recording head according to claim 1, wherein the functional devices are formed on the element substrate having said heat generating portions arranged thereon to drive said heat generating portions.

12. An ink jet recording head according to claim 1, wherein film boiling is created in ink by the application of thermal energy generated by said heat generating portions to discharge ink.

13. An ink jet cartridge comprising:

an ink jet recording head according to claim 1; and an ink tank for retaining ink to be supplied to said ink jet recording head.

14. An ink jet recording apparatus comprising:

holding means for detachably holding the ink jet cartridge according to claim 13; and means for supplying recording signals for supplying recording signals to drive said ink jet recording head, recording being performed by discharging ink from said ink jet recording head in accordance with recording signals.

15. An ink jet recording apparatus comprising:

an ink jet recording head according to claim 1; and means for supplying recording signals for supplying recording signals to drive said ink jet recording head, recording being performed by discharging ink from said ink jet recording head in accordance with recording signals.

16. A substrate for use of an ink jet recording head comprising:

ink paths communicated with ink discharge ports for discharging ink; and heat generating portions arranged on the inner wall faces of said ink paths for generating thermal energy utilized for discharging ink from said discharge ports, liquid-repellent treatment being processed only on the regions corresponding to said heat generating portions of the inner wall faces of said ink paths.

17. A substrate for use of an ink jet recording head according to claim 16, wherein the inner wall faces of said ink paths are lyophilic with the exception of the regions corresponding to said heat generating portions.

18. A substrate for use of an ink jet recording head according to claim 16, wherein an organic film is formed by means of said liquid-repellent treatment.

19. A substrate for use of an ink jet recording head according to claim 16, wherein said liquid-repellent treatment is a process using fluorine.

20. A substrate for use of an ink jet recording head according to claim 16, wherein said liquid-repellent treatment is a process to make the contact angle with ink 80° or more.

21. A substrate for use of an ink jet recording head according to claim 20, wherein said liquid-repellent treatment is a process to make the contact angle with ink 100° or more.

22. A substrate for use of an ink jet recording head according to claim 16, wherein the thickness of the film provided with said liquid-repellent treatment is 5,000 Å or less.

23. A substrate for use of an ink jet recording head according to claim 16, wherein the functional devices are formed on the element substrate having said heat generating portions arranged thereon to drive said heat generating portions.

24. A substrate for use of an ink jet recording head according to claim 16, wherein the regions corresponding to said heat generating portions are the inner wall faces of said ink paths corresponding to the heat generating resistive layer positioned between pairs of electrodes and portions nearby.

25. A substrate for use of an ink jet recording head according to claim 16, wherein the regions corresponding to said heat generating portions are formed on the uppermost layer of plural protection layers provided for said heat generating portions.

26. A substrate for use of an ink jet recording head according to claim 16, wherein said uppermost layer is a film containing tantalum.

* * * * *

UNITED STATES PATENT AND TRADEMARK OFFICE

CERTIFICATE OF CORRECTION

PATENT NO. : 6,142,606
DATED : November 7, 2000
INVENTOR(S) : Masahiko Kubota et al.

It is certified that error appears in the above-identified patent and that said Letters Patent is hereby corrected as shown below:

Title page:
[56] References Cited, under U.S. PATENT DOCUMENTS
Insert: -- 5,455,612 10/1995 Ikeda et al. 347/64 --; and
Under FOREIGN PATENT DOCUMENTS
Insert: -- 61-193861 08/1986 Japan --.

Column 1:
Line 48, "that" should read -- than --.

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*